US006251300B1

(12) United States Patent
Takigawa et al.

(10) Patent No.: US 6,251,300 B1
(45) Date of Patent: Jun. 26, 2001

(54) REFRIGERATOR OIL COMPOSITIONS AND FLUID COMPOSITIONS FOR REFRIGERATOR

(75) Inventors: Katsuya Takigawa; Umekichi Sasaki; Satoshi Suda, all of Yokohama (JP)

(73) Assignee: Nippon Mitsubishi Oil Corporation, Tokyo (JP)

( * ) Notice: Subject to any disclaimer, the term of this patent is extended or adjusted under 35 U.S.C. 154(b) by 0 days.

(21) Appl. No.: 09/094,367

(22) Filed: Jun. 9, 1998

Related U.S. Application Data

(63) Continuation-in-part of application No. 08/943,732, filed on Oct. 3, 1997, now abandoned, which is a continuation of application No. 08/509,880, filed on Aug. 1, 1995, now abandoned.

(30) Foreign Application Priority Data

Aug. 3, 1994 (JP) ..... 6-201322
Aug. 3, 1994 (JP) ..... 6-201323

(51) Int. Cl.[7] ..... C09K 5/00

(52) U.S. Cl. ..... 252/67; 252/68; 508/577; 508/582; 508/433

(58) Field of Search ..... 252/68, 67; 508/577, 508/580, 582, 459, 433, 421, 202

(56) References Cited

U.S. PATENT DOCUMENTS 4,046,533 9/1977 Olund ..... 62/468
4,199,461 * 4/1980 Olund ..... 252/68
5,154,846 * 10/1992 Thomas et al. ..... 252/68
5,262,076 * 11/1993 Ishida et al. ..... 252/68
5,391,311 * 2/1995 Ishida et al. ..... 252/68
5,431,835 * 7/1995 Katafuchi et al. ..... 252/68
5,445,753 * 8/1995 Fukuda et al. ..... 252/68
5,553,465 * 9/1996 Fukuda et al. ..... 62/468
5,554,311 * 9/1996 Katafuchi et al. ..... 252/68

FOREIGN PATENT DOCUMENTS 0496937 8/1992 (EP) .
0557796 9/1993 (EP) .
0693546 1/1996 (EP) .
9005172 5/1990 (WO) .
90/05172 * 5/1990 (WO) .

OTHER PUBLICATIONS

Abstract of Japanese Pat. Appln. Laid–Open Gazette No. Hei 6–184576(A), Jul. 1994.

* cited by examiner

*Primary Examiner*—Necholus Ogden
(74) *Attorney, Agent, or Firm*—Bucknam and Archer

(57) ABSTRACT

A refrigerator oil composition for use with an HFC refrigerant containing HFC-134*a*, HFC-125 or a mixture thereof, which comprises component (A) and component (B), said component (A) being 70 to 99% by weight of an alkylbenzene oil containing at least 60% by weight, based on the total weight of component (A), of alkylbenzenes having a molecular weight of 200 to 350 and said component (B) being 30 to 1% by weight of at least one synthetic oil containing oxygen selected from the group consisting of an ester, a polyalkylene glycol, an alkyl ether of the polyalkylene glycol, a modified compound of polyglycol, a ketone, a polyphenyl ether, a silicone, a polysiloxane and a perfluoro ether.

18 Claims, 1 Drawing Sheet

REFRIGERATOR OIL COMPOSITIONS AND FLUID COMPOSITIONS FOR REFRIGERATOR

This application is a Continuation-in-part of U.S. Ser. No. 08/943,732 filed on Oct. 3, 1997 now abandoned which was a Continuation of U.S. Ser. No. 08/509,880 filed Aug. 1, 1995 now abandoned.

BACKGROUND OF THE INVENTION

1. Field of the Invention

This invention relates to a refrigerator oil composition and a fluid composition for a refrigerator, and in particular to a refrigerator oil composition and a fluid composition containing said oil composition for use in a refrigerator, the refrigerator oil comprising a mixed base oil consisting essentially of an alkyl benzene oil having specific features and a synthetic oil and being suited for use in combination with an HFC refrigerant containing 1,1,1,2-tetrafluoroethane (HFC-134a) and/or pentafluoroethane (HFC-125).

2. Prior Art

Due to the recent problems as to the destruction of the ozone layer, the use of CFC (chlorofluorocarbon) and HCFC (hydrochlorofluorocarbon) which have been conventionally used as a refrigerant for a refrigerator is now restricted under a regulation. Therefore, as a replacement of these materials, HFC (hydrofluorocarbon) has been increasingly employed as a refrigerant.

Under the circumstances, PAG (polyalkylene glycol) and esters which are compatible with HFC have been studied or used as an oil for a refrigerator using an HFC refrigerant. For example, the use of PAG is proposed in U.S. Pat. No. 4,755.316; Japanese Patent Unexamined Publications Nos. Hei 1-198694, Hei 1-256594, Hei 1-259093, Hei 1-259094, Hei 1-259095, Hei 1-274191, Hei 2-43290, Hei 2-55791 and Hei 2-84491. The use of esters is proposed in PCT. Publication No. Hei 3-505602 as well as in Japanese Patent Unexamined Publications Nos. Hei 3-88892, Hei 2-128991, Hei 3-128992, Hei 3-200895, Hei 3-227397, Hei 4-20597, Hei 4-72390, Hei 4-218592 and Hei 4-249593.

However, PAG is rather high in hygroscopicity and poor in electric characteristics (volume resistivity). On the other hand, ester-based oils are readily hydrolyzed to generate an acid thus possibly giving rise to various problems. Moreover, these oils are accompanied with a serious problem that they are inferior in lubricity as compared with a mineral oil/CFC or a mineral oil/HCFC.

On the other hand, Japanese Patent Unexamined Publication No. Hei 5-157379 describes a refrigerating system for an HFC-134a refrigerant wherein there is used a refrigerator oil which is incompatible with a refrigerant; as an example of such an incompatible oil, an alkylbenzene oil is disclosed therein. Further, Japanese Patent Unexamined Publication No. Hei 5-59386 describes a mixed oil comprising a hydrocarbon compound and ester or ether, which is useful as a refrigerator oil for a refrigerator using tetrafluoroethane. However, it has been found that if an ordinary alkylbenzene oil is to be used as a refrigerator oil for HFC-134a and/or HFC-125, some specific means is required to be taken on the side of the system, and that if an ordinary alkylbenzene oil is used as a refrigerator oil for HFC-134a and/or HFC-125 without taking such specific means, the seizure of a refrigerating compressor used may possibly be caused after a long period of its operation.

The present inventors took notice of an alkylbenzene oil (alkylbenzenes) which is free from hydrolysis and hygroscopicity and made an extensive study to finally find out that if a mixture comprising an alkylbenzene oil having a specific property and a specific synthetic oil is used as a refrigerator oil for HFC-134a and/or HFC-125, the seizure of the refrigerating compressor can be avoided, thus indicating an excellent lubricity of the alkylbenzene oil, and that the alkylbenzene oil is capable of maintaining a high reliability for a long period of time. This invention has thus been accomplished in one aspect.

It has further been found out by the present inventors that when a phosphorus compound is added in a specific ratio to the above mixed base oil comprising an alkylbenzene oil having a specific property and a synthetic oil and the resulting mixture is used as a refrigerator oil composition in a refrigerator, the wear resistance and load resistance of the refrigerator can be improved. This invention has thus been accomplished in another aspect.

SUMMARY OF THE INVENTION

An object of the present invention is to provide a refrigerator oil composition to be used with an HFC refrigerant containing HFC-134a and/or HFC-125, which enables a refrigerating compressor to be prevented from its seizure, is excellent in lubricity and retains high reliability for a long period of time.

Another object of the present invention is to provide a fluid composition for use in a refrigerator, which comprises the above refrigerator oil composition and an HFC refrigerant containing HFC-134a and/or HFC-125.

In a first aspect of this invention, there is provided a refrigerator oil composition for use with an HFC refrigerant containing HFC-134a, HFC-125 or a mixture thereof, which comprises component (A) and component (B), said component (A) being 70 to 99% by weight of an alkylbenzene oil containing at least 60% by weight, based on the total weight of component (A), of alkylbenzenes having a molecular weight of 200 to 350 and said component (B) being 30 to 1% by weight of at least one synthetic oil containing oxygen selected from the group consisting of an ester, a polyalkylene glycol, an alkyl ether of the polyalkylene glycol, a modified compound of polyglycol, a ketone, a polyphenyl ether, a silicone, a polysiloxane and a perfluoro ether.

In a second aspect of this invention, there is provided a refrigerator fluid composition which comprises:

(I) an HFC refrigerant containing HFC-134a, HFC-125 or a mixture thereof and (II) a refrigerator oil comprising component (A) and component (B), said component (A) being 70 to 99% by weight of an alkylbenzene oil containing at least 60% by weight, based on the total weight of component (A), of alkylbenzenes having a molecular weight of 200 to 350 and said component (B) being 30 to 1% by weight of at least one synthetic oil containing oxygen selected from the group consisting of an ester, a polyalkylene glycol, an alkyl ether of the polyalkylene glycol, a modified compound of polyglycol, a ketone, a polyphenyl ether, a silicone, a polysiloxane and a perfluoro ether.

DESCRIPTION OF THE PREFERRED EMBODIMENTS

Figure 1:
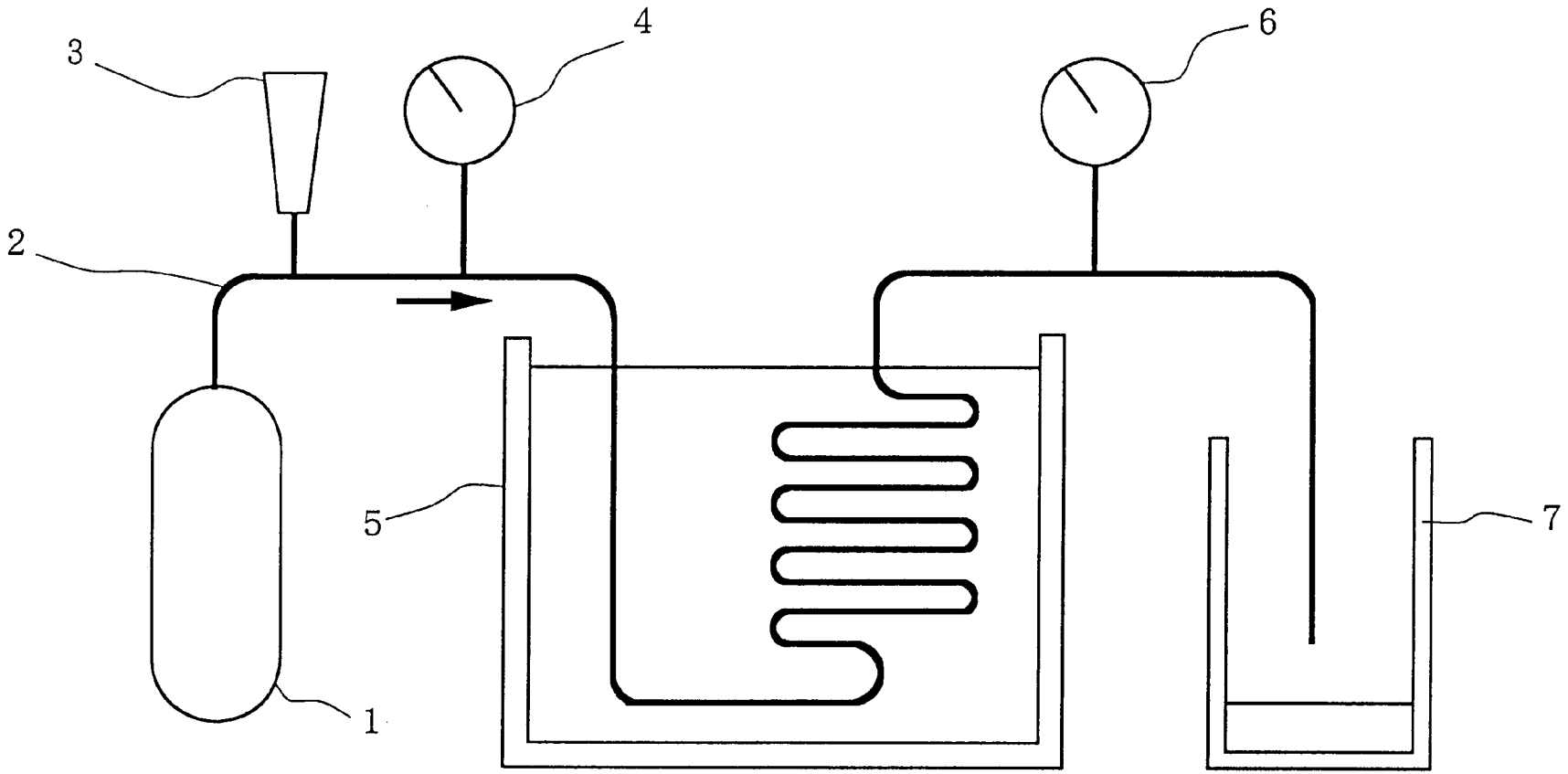
FIG. 1 is a schematic view of the testing apparatus used in the Evaluation Test Nos. 4 and 8, wherein the reference numeral 1 represents a refrigerating tank; 2, a copper conduit; 3, a flow meter; 4 and 6, manometers respectively; 5, a thermostatic tank; and 7, an oil pan.

This invention will be further explained in detail with reference to the following preferred embodiments.

The component (A) of the refrigerator oil or oil composition (these expressions will hereinafter be collectively referred to simply as a refrigerator oil composition) proposed by this invention comprises an alkylbenzene oil containing at least 60% by weight (based on total weight of the component (A)) of alkylbenzenes having a molecular weight of 200 to 350.

To be more specific, it is required for the alkylbenzene oil to contain, based on total weight of the component (A), at least 60% by weight, preferably at least 65% by weight, more preferably at least 70% by weight, still more preferably at least 80% by weight, most preferably 100% by weight of alkylbenzenes having a molecular weight of 200 to 350. If there is employed an alkylbenzene oil which does not meet the above requirements the seizure of a refrigerating compressor used may possibly be caused after a long period of its operation, thus undesirably affecting the reliability of the refrigerator oil.

Further, in view of improving the property for preventing the generation of seizure of a refrigerating compressor during a long period of its operation, the alkylbenzene oil may desirably be selected from those containing, based on total weight of the component (A), at least 30% by weight, more preferably at least 35% by weight, most preferably at least 40% by weight of alkylbenzenes having a molecular weight of 200 to 300 with the proviso that the alkylbenzene oil contains at least 60% by weight, based on total weight of the component (A), of alkylbenzenes having a molecular weight of 200 to 350.

As for the alkylbenzene oil constituting the component (A) of the refrigerator oil composition of this invention, there is no restriction with respect to the molecular structure of the component alkylbenzenes as far as the molecular weight thereof falls within the range of from 200 to 350. However, in view of improving a long-term reliability of a refrigerating system, it is preferable to select an alkylbenzene oil (a) composed of alkylbenzenes having 1 to 4 alkyl groups, each group containing 1 to 19 carbon atoms and the total amount of carbon atoms in the alkyl group being 9 to 19, and more preferably to select alkylbenzenes having 1 to 4 alkyl groups, each group containing 1 to 15 carbon atoms and the total amount of carbon atoms in the alkyl group being 9 to 15.

Examples of alkyl groups containing 1 to 19 carbon atoms are methyl, ethyl, propyl (including all isomers), butyl (including all isomers), pentyl (including all isomers), hexyl (including all isomers), heptyl (including all isomers), octyl (including all isomers), nonyl (including all isomers), decyl (including all isomers), undecyl (including all isomers), dodecyl (including all isomers), tridecyl (including all isomers), tetradecyl (including all isomers), pentadecyl (including all isomers), hexadecyl (including all isomers), heptadecyl (including all isomers), octadecyl (including all isomers) and nonadecyl (including all isomers).

These alkyl groups may be straight-chain or branched-chain ones. However, in view of the stability and viscosity of the alkylbenzenes, branched-chain alkyl groups are preferable, and the branched-chain alkyl groups that are derived from oligomers of olefins such as propylene, butene and isobutylene in view of availability.

The number of alkyl groups in the alkylbenzenes defined in the above (a) is confined to 1 to 4. However, in view of the stability and availability of the alkylbenzenes, it is the most preferable to select alkylbenzenes having one or two of alkyl groups, i.e., a monoalkylbenzene, a dialkylbenzene or a mixture of them.

It is also possible to employ not only the alkylbenzenes defined in the above (a) which have the same molecular structure, but also those having different molecular structures as long as there are satisfied the conditions that they contain 1 to 4 alkyl groups, each group containing 1 to 19 carbon atoms and the total amount of carbon atoms in the alkyl group being 9 to 19.

It is permissible for the alkylbenzene oil constituting the component (A) to contain less than 40% by weight, preferably less than 35% by weight, or more preferably less than 30% by weight, of alkylbenzenes having a molecular weight of less than 200 or more than 350. However, it is preferable that the molecular weight of such alkylbenzenes be confined to a range of more than 350 to 450, more preferably more than 350 to 430 in view of retaining reliability during a long period of operation of a compressor used.

With respect to the alkylbenzenes having a molecular weight ranging from more than 350 to 450, there are no restrictions imposed on the molecular structure thereof as far as the molecular weights fall within this range. However, in view of the stability and availability, of alkylbenzenes it is preferable to select alkylbenzenes (b) having 1 to 4 alkyl groups, each group containing 1 to 40 carbon atoms and the total amount of carbon atoms in the alkyl group being 20 to 40, and more preferably to select alkylbenzenes having 1 to 4 alkyl groups, each group containing 1 to 30 carbon atoms and the total amount of carbon atoms in the alkyl group being 20 to 30.

Examples of alkyl groups containing 1 to 40 carbon atoms are methyl, ethyl, propyl (including all isomers), butyl (including all isomers), pentyl (including all isomers), hexyl (including all isomers), heptyl (including all isomers), octyl (including all isomers), nonyl (including all isomers), decyl (including all isomers), undecyl (including all isomers), dodecyl (including all isomers), tridecyl (including all isomers), tetradecyl (including all isomers), pentadecyl (including all isomers), hexadecyl (including all isomers), heptadecyl (including all isomers), octadecyl (including all isomers), nonadecyl (including all isomers), icosyl groups (including all isomers), henicosyl groups (including all isomers), docosyl groups (including all isomers), tricosyl groups (including all isomers), tetracosyl groups (including all isomers), heptacosyl groups (including all isomers), hexacosyl groups (including all isomers), heptacosyl groups (including all isomers), octacosyl groups (including all isomers), nonacosyl groups (including all isomers), triacontyl groups (including all isomers), hentriacontyl groups (including all isomers), dotriacontyl groups (including all isomers), tritriaccontyl groups (including all isomers), tetratriacontyl groups (including all isomers), pentatriacontyl groups (including all isomers), hexatriacontyl groups (including all isomers), heptatriacontyl groups (including all isomers), octatriacontyl groups (including all isomers), nonatriacontyl groups (including all isomers) and tetracontyl groups (including all isomers).

These alkyl groups may be straight-chain or branched-chain ones. However, in view of the stability and viscosity of the alkylbenzene, branched-chain alkyl groups are preferable; and branched-chain alkyl groups that are derived from an oligomer of an olefin such as propylene, butene or isobutylene are more preferable in view of their availability.

The number of alkyl groups in the alkylbenzenes defined in the above (b) is confined to 1 to 4. However, in view of the stability and availability of the alkylbenzenes, it is the most preferable to select alkylbenzenes having one or two alkyl groups, i.e., a monoalkylbenzene, a dialkylbenzene and a mixture thereof.

It is also possible to employ not only the alkylbenzenes defined in the above (b) which have the same molecular structure, but also those having different molecular structures as long as there are satisfied the conditions that they contain 1 to 4 alkyl group, each group containing 1 to 40 carbon atoms and the total amount of carbon atoms in the alkyl group being 20 to 40.

Although there is no specific restriction imposed on the viscosity of the alkylbenzenes constituting the component (A) of the refrigerator oil composition of this invention, it is preferable to select alkylbenzenes having a kinematic viscosity of 3 to 50 $mm^2/s$, more preferably 4 to 40 $mm^2/s$, and most preferably 5 to 35 $mm^2/s$ at a temperature of 40° C.

There is no restriction placed on the manufacturing method of the alkylbenzene oil constituting the component (A) of the refrigerator oil composition of this invention, and the alkylbenzene oil can be manufactured according to the following synthesizing methods.

Aromatic compounds which may be used as a raw material include benzene, toluene, xylene, ethylbenzene, methylethylbenzene, diethylbenzene and a mixture thereof. Alkylating agents, which may be used herein include a lower mono-olefin such as ethylene, propylene, butene or isobutylene; preferably an olefin of a straight-chain or branched-chain type having 6 to 40 carbon atoms that is obtained by the polymerization of propylene; an olefin of a straight-chain or branched-chain type having 6 to 40 carbon atoms that is obtained by the thermal decomposition of wax, heavy oil, a petroleum fraction, polyethylene, polypropylene or the like; an olefin of a straight-chain type having 6 to 40 carbon atoms that is obtained by separating n-paraffin from a petroleum fraction such as kerosine or gas oil and then catalytically transforming the n-paraffin into an olefin; and a mixture of these olefins.

An alkylating catalyst for use in the alkylation includes a conventional catalyst exemplified by a Friedel-Crafts catalyst such as aluminum chloride or zinc chloride; or an acidic catalyst such as sulfuric acid, phosphoric acid, silicotungstic acid, hydrofluoric acid or activated clay.

The alkylbenzene oil constituting the component (A) of the refrigerator oil composition of this invention may be obtained by mixing separately prepared alkylbenzenes having a molecular weight ranging from 200 to 350 with alkylbenzenes having a molecular weight of less than 200 or more than 350 in a ratio as defined by this invention. However, it is advisable in practice to obtain a distillate containing at least 60% by weight of alkylbenzenes having a molecular weight ranging from 200 to 350 through distillation or chromatography from a mixture of alkylbenzenes which is manufactured according to the method explained above or is available in the market.

Meanwhile, the component (B) of the refrigerator oil composition of this invention is a synthetic oil containing oxygen. Preferable examples of this component (B) are an ester, polyglycol, ketone, polyphenyl ether, silicone, polysiloxane and perfluoro ether. Among them, (c) ester, (d) polyglycol, (e) ketone and a mixture of them are especially preferable.

Examples of (c) esters are a dibasic ester, a polyol ester, a complex ester, a polyol carbonate and a mixture of them.

Examples of dibasic esters are those that can be obtained by reacting a dibasic acid having 5 to 10 carbon atoms such as glutamic acid, adipic acid, pimelic acid, suberic acid, azelaic acid or sebacic acid with a monohydric alcohol having 1 to 15 carbon atoms and an alkyl group of a straight-chain or branched-chain type, such as methanol, ethanol, propanol, butanol, pentanol, hexanol, heptanol, octanol, nonanol, decanol, undecanol, dodecanol, tridecanol, tetradecanol or pentadecanol. These esters may also be used as a mixture. More particularly, these esters include ditridecyl glutarate, di 2-ethylhexyl adipate, diisodecyl adipate, ditridecyl adipate, di 2-ethylhexyl sebacate and a mixture of them.

Examples of polyol esters are esters between a diol or a polyol having 3 to 20 hydroxyl groups and a fatty acid having 6 to 20 carbon atoms. More particularly, such diols include ethylene glycol, 1,3-propanediol, propylene glycol, 1,4-butanediol, 1,2-butanediol, 2-methyl-1,3-propanediol, 1,5-pentanediol, neopentyl glycol, 1,6-hexanediol, 2-ethyl-2-methyl-1,3-propanediol, 1,7-heptanediol, 2-methyl-2-propyl-1,3-propanediol, 2,2-diethyl-1,3-propanediol, 1,8-octanediol, 1,9-nonanediol, 1,10-decanediol, 1,11-undecanediol and 1,12-dodecanediol. Specific examples of polyol are polyalcohols such as trimethylolethane, trimethylolpropane, trimethylolbutane, di-(trimethylolpropane), tri-(trimethylolpropane), pentaerythritol, di-(pentaerythritol), tri-(pentaerythritol), glycerin, polyglycerin (glycerin dimer to icosamer), 1,3,5-pentanetriol, sorbitol, sorbitan, sorbitol-glycerin condensate, adonitol, arabitol, xylitol and mannitol; saccharides such as xylose, arabinose, ribose, rhamnose, glucose, fructose, galactose, mannose, sorbose, cellobiose, maltose, isomaltose, trehalose, sucrose, raffinose, gentianose and melezitose, the partially etherified products of these polyalcohols and saccharides; and methylglucoside. More particularly, such fatty acids include pentanoic acid, hexanoic acid, heptanoic acid, octanoic acid, nonanoic acid, decanoic acid, undecanoic acid, dodecanoic acid, tridecanoic acid, tetradecanoic acid, pentadecanoic acid, hexadecanoic acid, heptadecanoic acid, octadecanoic acid, nonadecanoic acid, icosanoic acid, oleic acid (these fatty acids may be of a straight-chain or branched-chain type), or a neo acid where $\alpha$ carbon atom thereof is quaternary. More specifically, valeric acid, isopentanoic acid, caproic acid, enanthic acid, 2-methylhexanoic acid, 2-ethylpentanoic acid, caprylic acid, 2-ethylhexanoic acid, pelargonic acid, 3,5,5-trimethylhexanoic acid may be preferably empoyed as a fatty acid. Polyolester may contain a free hydroxyl group. Preferable examples of the polyol ester are esters of a hindered alcohol such as neopentyl glycol, trimethylolethane, trimethylolpropane, trimethylolbutane, di-(trimethylolpropane), tri-(trimethylolpropane), pentaerythritol, di-(pentaerythritol) and tri-(pentaerythritol). Specific examples are neopentylglycol 2-ethylhexanoate, trimethylolpropane caprate, trimethylolpropane pelargonate, pentaerythritol 2-ethylhexanoate, pentaerythritol pelargonate or a mixture of them.

A complex ester is an ester obtained by reacting a fatty acid and a dibasic acid with a monohydric alcohol and a polyol. Examples of fatty acids, dibasic acids, monohydric alcohols and polyols useful in this case may be the same as exemplified above with reference to dibasic esters and polyol esters.

A polyol carbonate ester is an ester obtained by reacting carbonic acid with a monohydric alcohol and a polyol. Examples of monohydric alcohols and polyols useful in this case may be not only the same as exemplified above, but also polyglycol obtained through homopolymerization or copolymerization of a diol, and products which are obtainable by the addition reaction of polyglycol with the polyol mentioned above.

Examples of polyglycol (d) suitable in this case are polyalkylene glycols, alkyl ethers thereof and modified compounds thereof.

Examples of polyalkylene glycols are homopolymers or copolymers of an alkylene oxide such as ethylene oxide, propylene oxide or butylene oxide. When a polyalkylene glycol is formed of a copolymer of alkylene oxides different in structure from each other, there is no restriction placed on the polymerization form of oxyalkylene groups, i.e., the form may be random copolymerization or block copolymerization.

An alkyl ether of the polyalkylene glycol is a compound wherein the hydroxyl group of the polyalkylene glycol is etherified. Examples of alkyl ethers of the polyalkylene glycol are monomethyl ether, monoethyl ether, monopropyl ether, monobutyl ether, monopentyl ether, monohexyl ether, monoheptyl ether, monooctyl ether, monononyl ether, monodecyl ether, dimethyl ether, diethyl ether, dipropyl ether, dibutyl ether, dipentyl ether, dihexyl ether, diheptyl ether, dioctyl ether, dinonyl ether and didecyl ether.

Examples of the modified compounds of polyglycol are an adduct of polyol with an alkylene oxide, an alkyl ether of an adduct of polyol with an alkylene oxide, an ester of the polyalkylene glycol, an ester of a monoalkyl ether of the polyalkylene glycol, an ester of an adduct of polyol with an alkylene oxide and an ester of a partial alkyl ether of an adduct of polyol with an alkylene oxide. Examples of polyol useful in this case may be the same as those exemplified in reference to polyol esters. Examples of acids which constitute the esters may be fatty acids as exemplified in reference to polyol esters.

Examples of ketones (e) mentioned above are ones which contain in the molecule at least one group represented by the following general formula:

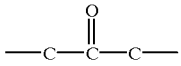

More particularly, the ketones (e) include ketone compounds represented by the following formulas (1), (2) and (3), and a mixture of these ketone compounds.

(1)

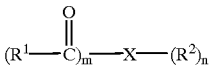

wherein X is an m+n valent aromatic ring or an alkyl-substituted aromatic ring having 6 to 50 carbon atoms, preferably 6 to 20 Carbon atoms; $R^1$ and $R^2$ may be the same or different and are each a hydrocarbon group having 1 to 50 carbon atoms, preferably 1 to 30 carbon atoms, preferable examples thereof being an alkyl, phenyl or alkylphenyl group; m and n may be the same or different integers and are each 1 to 20, preferably 1 to 10.

Preferable examples of the aromatic ring representing X are a benzene ring, a naphthalene ring, an anthracene ring, a phenanthrene ring and an alkyl-substituted aromatic ring wherein at least one hydrogen atom on said aromatic rings is substituted by an alkyl group having 1 to 20 carbon atoms.

Preferable examples of $R^1$ and $R^2$ are methyl, ethyl, propyl (including all isomers), butyl (including all isomers), pentyl (including all isomers), hexyl (including all isomers), heptyl (including all isomers), octyl (including all isomers), nonyl (including all isomers), decyl (including all isomers), undecyl (including all isomers), dodecyl (including all isomers), tridecyl (including all isomers), tetradecyl (including all isomers), pentadecyl (including all isomers), hexadecyl (including all isomers), heptadecyl (including all isomers), octadecyl (including all isomers), nonadecyl (including all isomers), icosyl (including all isomers), henicosyl (including all isomers), docosyl (including all isomers), tricosyl (including all isomers), tetracosyl (including all isomers), heptacosyl (including all isomers), hexacosyl (including all isomers), heptacosyl (including all isomers), octacosyl (including all isomers), nonacosyl (including all isomers), triacontyl (including all isomers), phenyl, tolyl (including all isomers), xylyl (including all isomers), ethylphenyl (including all isomers), propylphenyl (including all isomers), ethylmethylphenyl (including all isomers), butylphenyl (including all isomers), diethylphenyl (including all isomers), pentylphenyl (including all isomers), hexylphenyl (including all isomers), heptylphenyl (including all isomers), octylphenyl (including all isomers), nonylphenyl (including all isomers), decylphenyl (including all isomers), undecylphenyl (including all isomers), dodecylphenyl (including all isomers), tridecylphenyl (including all isomers), tetradecylphenyl (including all isomers), pentadecylphenyl (including all isomers), hexadecylphenyl (including all isomers), heptadecylphenyl (including all isomers), octadecylphenyl (including all isomers), nonadecylphenyl (including all isomers), icosylphenyl (including all isomers), henicosylphenyl (including all isomers), docosylphenyl (including all isomers), tricosylphenyl (including all isomers) and tetracosylphenyl (including all isomers).

(2)

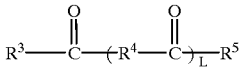

wherein $R^3$ and $R^5$ may be the same or different and are individually a hydrocarbon group having 1 to 50 carbon atoms, preferably 1 to 30 carbon atoms, preferably an alkyl, a phenyl or an alkylphenyl group; $R^4$ is an alkylene group having 1 to 19 carbon atoms, preferably 1 to 10 carbon atoms; L is an integer of 1 to 5, preferably 1 to 3.

Preferable examples of $R^3$ and $R^5$ are alkyl, phenyl and alkylphenyl groups by which are exemplified $R^1$ and $R^2$ in the compounds represented by the general formula (1).

Further, $R^4$ is preferably an alkylene group which includes methylene, ethylene (including all isomers), propylene (including all isomers), butylene (including all isomers), pentylene (including all isomers), hexylene (including all isomers), heptylene (including all isomers), octylene (including all isomers), nonylene (including all isomers) or decylene group (including all isomers).

(3)

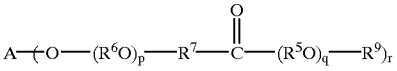

wherein A is a monohydric to icosahydric alcohol residue; $R^6$, $R^7$ and $R^8$ may be the same or different and are individually an alkylene group having 1 to 4 carbon atoms; $R^9$ is a hydrocarbon group, preferably an alkyl, phenyl or alkylphenyl group each having 1 to 50 carbon atoms, preferably 1 to 30 carbon atoms; p and q may be the same or different integers and are individually 0 to 30, preferably 0 to 20; and r is an integer of 1 to 20.

Alcohols for the alcohol residue A include aliphatic monohydric alcohols such as methanol, ethanol, propanol (including all isomers), butanol (including all isomers), pentanol (including all isomers), hexanol (including all isomers), heptanol (including all isomers), octanol (including all isomers), nonanol (including all isomers), decanol (including all isomers), undecanol (including all isomers), dodecanol (including all isomers), tridecanol (including all isomers), tetradecanol (including all isomers), pentadecanol (including all isomers), hexadecanol (including all isomers), heptadecanol (including all isomers), octadecanol (including all isomers), nonadecanol (including all isomers), icosanol (including all isomers), henicosanol (including all isomers), docosanol (including all isomers), tricosanol (including all isomers) and tetracosanol (including all isomers); diols such as ethylene glycol, 1,3-propanediol, propylene glycol, 1,4-butanediol, 1,2-butanediol, 2-methyl-1,3-propanediol, 1,5-pentanediol, neopentyl glycol, 1,6-hexanediol, 2-ethyl-2-methyl-1,3-propanediol, 1,7-heptanediol, 2-methyl-2-propyl-1,3-propanediol, 2,2-diethyl-1,3-propanediol, 1,8-octanediol, 1,9-nonanediol, 1,10-decanediol, 1,11-undecarnediol and 1,12-dodecanediol; polyols including polyhydric alcohols such as trimethylolethane, trimethylolpropane, trimethylolbutane, di-(trimethylolpropane), tri-(trimethylolpropane), pentaerythritol, di-(pentaerythritol), tri-(pentaerythritol), glycerin, polyglycerin (glycerin dimer to icosamer consisting of 2 to 20 glycerin monomers), 1,3,5-pentanetriol, sorbitol, sorbitan, sorbitol-glycerin condensate, adonitol, arabitol, xylitol and mannitol, and saccharides such as xylose, arabinose, ribose, rhamnose, glucose, fructose, galactose, mannose, sorbose, cellobiose, maltose, isomaltose, trehalose, sucrose, raffinose, gentianose and melezitose, the partially etherified products of these polyalcohols and saccharides; and methylglucoside.

Preferable examples of alkylene groups representing $R^6$, $R^7$ and $R^8$ are methylene, ethylene (including all isomers), propylene (including all isomers) and butylene (including all isomers).

Preferable examples of $R^9$ are alkyl, phenyl and alkylphenyl groups by which are exemplified $R^1$ and $R^2$ in the compounds represented by the general formula (1).

The lower limit of the content of the component (A) in a refrigerator oil (a mixed base oil) of this invention comprising the components (A) and (B) is at least 70% by weight, preferably at least 75% by weight, more preferably at least 80% by weight, based on the total weight of the components (A) and (B), while the upper limit of the content of the component (B) is not more than 30% by weight, preferably not more than 25% by weight, more preferably not more than 20% by weight, based on the total weight of the components (A) and (B).

On the other hand, the upper limit of the content of the component (A) in a refrigerator oil (a mixed base oil) of this invention comprising the components (A) and (B) is not more than 99% by weight, preferably not more than 95% by weight, more preferably not more than 90% by weight, based on the total weight of the components (A) and (B), while the lower limit of the content of the component (B) is at least 1% by weight, preferably at least 5% by weight, more preferably at least 10% by weight, based on the total weight of the components (A) and (B).

If the lower limit of the content of the component (A) is less than 70% by weight based on the total weight of the components (A) and (B), a long term reliability of the refrigerator oil composition will be undesirably deteriorated. On the other hand, if the upper limit of the content of the component (A) is more than 99% by weight based on the total weight of the components (A) and (B), the return of the refrigerator oil composition in a refrigerating system will be undesirably deteriorated.

The refrigerator oil of this invention comprises (A) an alkylbenzene oil (alkylbenzenes) and (B) a synthetic oil containing oxygen as defined above, which can be suitably used as a refrigerator oil for an HFC refrigerant containing HFC-134a and/or HFC-125 without accompaniment of an additive. However, it is also possible to use in the form of a refrigerator oil composition containing therein any of various additives as required.

In particular, it is preferable to blend a phosphorus compound (C) in view of improving the refrigerating apparatus in wear resistance and load resistance by the use of the refrigerator oil composition. The phosphorus compound (C) means in this case at least one kind of a phosphorus compound selected from the group consisting of phosphoric esters, acidic phosphoric esters, amine salt of acidic phosphoric esters, chlorinated phosphoric esters and phosphorous esters.

These phosphorus compounds are esters obtained by a reaction between phosphoric acid or phosphorous acid and an alkanol or polyether type alcohol, and are also derivatives of said esters.

Examples of phosphoric esters are tributyl phosphate, tripentyl phosphate, trihexyl phosphate, triheptyl phosphate, trioctyl phosphate, trinonyl phosphate, tridecyl phosphate, triundecyl phosphate, tridodecyl phosphate, tritridecyl phosphate, tritetradecyl phosphate, tripentadecyl phosphate, trihexadecyl phosphate, triheptadecyl phosphate, trioctadecyl phosphate, trioleyl phosphate, triphenyl phosphate, tricresyl phosphate, trixylyl phosphate, cresyldiphenyl phosphate and xylyldiphenyl phosphate.

Examples of acidic phosphoric esters are monobutyl acid phosphate, monopentyl acid phosphate, monohexyl acid phosphate, monoheptyl acid phosphate, monooctyl acid phosphate, monononyl acid phosphate, monodecyl acid phosphate, monoundecyl acid phosphate, monododecyl acid phosphate, monotridecyl acid phosphate, monotetradecyl acid phosphate, monopentadecyl acid phosphate, monohexadecyl acid phosphate, monoheptadecyl acid phosphate, monooctadecyl acid phosphate, monooleyl acid phosphate, dibutyl acid phosphate, dipentyl acid phosphate, dihexyl acid phosphate, diheptyl acid phosphate, dioctyl acid phosphate, dinonyl acid phosphate, didecyl acid phosphate, diundecyl acid phosphate, didodecyl acid phosphate, ditridecyl acid phosphate, ditetradecyl acid phosphate, dipentadecyl acid phosphate, dioctadecyl acid phosphate and dioleyl acid phosphate.

Examples of amine salts of acidic phosphoric esters are methylamine, ethylamine, propylamine, butylamine, pentylamine, hexylamine, heptylamine, octylamine, dimethylamine, diethylamine, dipropylamine, dibutylamine, dipentylamine, dihexylamine, diheptylamine, dioctylamine, trimethylamine, triethylamine, tripropylamine, tributylamine, tripentylamine, trihexylamine, triheptylamine and trioctylamine of the acidic phosphoric ester.

Examples of chlorinated phosphoric esters are tris-dichloropropyl phosphate, tris-chloroethyl phosphate, tris-chlorophenyl phosphate and polyoxyalkylene bis[di (chloroalkyl)] phosphate. Examples of phosphorous esters are dibutyl phosphite, dipentyl phosphite, dihexyl phosphite, diheptyl phosphite, dioctyl phosphite, dinonyl phosphite, didecyl phosphite, diundecyl phosphite, didodecyl phosphite, dioleyl phosphite, diphenyl phosphite, dicresyl phosphite, tributyl phosphite, tripentyl phosphite, trihexyl phosphite, triheptyl phosphite, trioctyl phosphite, trinonyl phosphite, tridecyl phosphite, triundecyl phosphite, tridodecyl phosphite, trioleyl phosphite, triphenyl phosphite and tricresyl phosphite. It is also possible to use a mixture of these compounds.

These phosphorus compounds may be incorporated into a refrigerator oil composition in any desired mixing ratio. However, it is generally preferable to add these phosphorus compounds in the ratio of 0.005 to 5.0 parts by weight, more preferably 0.01 to 3.0 parts by weight, based on 100 parts by weight of the total amount of the alkylbenzene oil (A) and the synthetic oil containing oxygen (B).

If the amount of the phosphorus compound added is less than 0.005 parts by weight based on 100 parts by weight of the total amount of the components (A) and (B), any substantial effect on the improvement of wear resistance and loading resistance would not be attained by the addition of said compound. On the other hand, if the amount of the phosphorus compound added exceeds 5.0% by weight based on 100 parts by weight of the total amount of the components (A) and (B), it may give rise to undesirable corrosion in a refrigerating system during its use for a long period of time.

The improvement in wear resistance and loading resistance to be attained by the addition of the phosphorus compound is one of the features of the refrigerator oil composition of this invention. It is certainly possible to achieve more or less an improvement in wear resistance and loading resistance, even with the use of PAG (polyalkylene glycol) or an ester which is each known as useful for a refrigerator oil used with HFC. However, the effect that can be attained by the use of these conventional compounds is far less than the effect to be achieved by the use of the refrigerator oil composition of this invention.

It is also possible for the purpose of improving stability to incorporate in the refrigerator oil composition of this invention at least one kind of an epoxy compound selected from the group consisting of:

(1) Phenylglycidyl ether type epoxy compounds,
(2) Alkylglycidyl ether type epoxy compounds,
(3) Glycidyl ester type epoxy compounds,
(4) Aryl oxirane compounds,
(5) Alkyl oxirane compounds,
(6) Alicyclic epoxy compounds,
(7) Epoxidized fatty monoesters,
(8) Epoxidized vegetable oils.

Examples of phenylglycidyl ether type epoxy compounds (1) are phenylglycidyl ether and alkylphenylglycidyl ether. The alkylphenylglycidyl ether used herein may be one having 1 to 3 alkyl groups each containing 1 to 13 carbon atoms, preferably one having one alkyl group containing 4 to 10 carbon atoms. Examples of such preferable alkylphenylglycidyl ethers are n-butylphenylglycidyl ether, i-butylphenylglycidyl ether, sec-butylphenylglycidyl ether, tert-butylphenylglycidyl ether, pentylphenylglycidyl ether, hexylphenylglycidyl ether, heptylphenylglycidyl ether, octylphenylglycidyl ether, nonylphenylglycidyl ether and decylphenylglycidyl ether.

Examples of alkylglycidyl ether type epoxy compounds (2) are decylglycidyl ether, undecylglycidyl ether, dodecylglycidyl ether, tridecylglycidyl ether, tetradecylglycidyl ether, 2-ethylhexylglycidyl ether, neopentylglycoldiglycidyl ether, trimethylolpropane triglycidyl ether, pentaerythritol tetraglycidyl ether, 1,6-hexadiol diglycidyl ether, sorbitol polyglycidyl ether, polyalkyleneglycol monoglycidyl ether and polyalkyleneglycol diglycidyl ether.

Examples of glycidyl ester type epoxy compounds (3) are phenylglycidyl ester, alkylglycidyl ester and alkenylglycidyl ester. Preferable examples thereof are glycidyl 2,2-dimethyloctanoate, glycidyl benzoate, glycidyl acrylate and glycidyl methacrylate.

Examples of aryl oxirane compounds (4) are 1,2-epoxystyrene and alkyl-1,2-epoxystyrene.

Examples of alkyl oxirane compounds (5) are 1,2-epoxybutane, 1,2-epoxypentane, 1,2-epoxyhexane, 1,2-epoxyheptane, 1,2-epoxyoctane, 1,2-epoxynonane, 1,2-epoxydecane, 1,2-epoxyundecane, 1,2-epoxydodecane, 1,2-epoxytridecane, 1,2-epoxytetradecane, 1,2-epoxypentadecane, 1,2-epoxyhexadecane, 1,2-epoxyheptadecane, 1,2-epoxyoctadecane, 1,2-epoxynonadecane and 1,2-epoxyeicosane.

Examples of alicyclic epoxy compounds (6) are 1,2-epoxycyclohexane, 1,2-epoxycylopentane, 3,4-epoxycyclohexylmethyl-3,4-epoxycyclohexane carboxylate, bis(3,4-epoxycyclohexylmethyl) adipate, exo-2,3-epoxynorbornane, bis(3,4-epoxy-6-methylcyclohexylmethyl) adipate, 2-(7-oxabicyclo[4.1.0] hept-3-yl)-spiro(1,3-dioxane-5,3'-[7]oxabicyclo[4.1.0]) heptane, 4-(1'-methylepoxyethyl)-1,2-epoxy-2-methylcyclohexane and 4-epoxyethyl-1,2-epoxycyclohexane.

Examples of epoxidized fatty monoesters (7) are an ester formed by reacting an epoxidized fatty acid having 12 to 20 carbon atoms with an alcohol having 1 to 8 carbon atoms, phenol or an alkylphenol. In particular, epoxystearates such as butyl, hexyl, benzyl, cyclohexyl, methoxyethyl, phenyl and butylphenyl esters of epoxystearic acid are preferred.

Examples of epoxidized vegetable oils (8) are epoxy compounds of a vegetable oil such as soybean oil, linseed oil or cottonseed oil.

Among these epoxy compounds, the more preferred ones are phenylglycidyl ether type epoxy compounds, glycidyl ester type epoxy compounds, aliycylic epoxy compounds and epoxidized fatty monoester are preferred. Among them, phenylglycidyl ether type epoxy compounds and glycbidyl ester type epoxy compounds with phenylglycidyl ether, butylphenylglycidyl ether and alkylglycidyl esters being the most preferred.

These epoxy compounds may be incorporated into a refrigerator oil in any desired mixing ratio. However, it is generally preferable to incorporated these epoxy compounds in the ratio of 0.1 to 5.0% by weight, more preferably 0.2 to 2.0% by weight, based on 100 parts by weight of the total amount of the alkylbenzene oil (A) and the synthetic oil containing oxygen (B).

It is of course possible to employ these phosphorus compounds and epoxy compounds jointly.

It is also possible, if required, to use singly or jointly suitable conventional additives in the refrigerator oil for the purpose of improving the properties of the oil composition of this invention. The suitable additives include, antioxidants of a phenol type such as di-tert-butyl-p-cresol and bisphenol A or of an amine type such as phenyl-α-naphthylamine and N,N-di(2-naphthyl)-p-phenylene diamine; anti-wear additives such as zinc dithiophosphate; extreme pressure agents such as chlorinated paraffin and sulfur compounds; an oiliness improvers such as a fatty acid; antifoaming agents such as silicone-type ones; metal inactivators such as benzotriazole; viscosity index improvers; pour point depressants; and detergent-dispersants. These additives may be used singly or in combination. These additives can be generally added in a ratio of not more than 10% by weight, more preferably not more than 5% by weight, based on 100 parts by weight of the total amount of the alkylbenzene oil (A) and the synthetic oil containing oxygen (B).

The refrigerants used, together with the refrigerator oil composition of this invention, in a refrigerator include an alkane fluoride having 1 to 3 carbon atoms, preferably 1 to 2 carbon atoms and containing at least 40% by weight of 1,1,1,2-tetrafluoroethane (HFC134*a*) and/or an alkane fluoride having 1 to 3 carbon atoms, preferably 1 to 2 carbon atoms and containing at least 20% by weight, preferably at least 30% by weight, more preferably at least 40% by weight of pentafluoroethane (HFC-125).

There is no restriction placed on the kind of HFC (hydrofluorocarbon) to be mixed with HFC-134a and/or HFC-125. The HFC includes trifluoromethane (HFC-23), difluoromethane (HFC-32) 1,1,2,2-tetrafluoroethane (HFC-134), 1,1,1-trifluoroethane (HFC-143a) or 1,1-difluoroethane (HFC-152a).

Examples of the HFC refrigerant containing 1,1,1,2-tetrafluoroethane (HFC-134a) and/or pentafluoroethane (HFC-125) that are useful in this invention are HFC-134a alone; HFC-125 alone: a mixture of HFC-134a/HFC-32 in a ratio of 60–80% by weight/40–20% by weight, a mixture of HFC-134a/HFC-32/HFC-125 in a ratio of 40–70% by weight/15–35% by weight/5–40% by weight, a mixture of HFC-125/HFC-32 in a ratio of :30–60% by weight/70–40% by weight, a mixture of HFC-125/HFC-143a in a ratio of 40–60% by weight/60–40% by weight and a mixture of (HFC-125/HFC-134a/HFC-143a in a ratio of 35–55% by weight/1–15% by weight/40–60% by weight.

More particularly, the HFC refrigerant mixtures are R404A (HFC-125/HFC-143a/HFC-134a in a ratio of 44% by weight/52% by weight/4% by weight), R407C (HFC-32/HFC-125/HFC-134a in a ratio of 23% by weight/25% by weight/52% by weight), R410A (HFC-32/HFC-125 in a ratio of 50% by weight/50% by weight), R410B (HFC-32/HFC-125 in a ratio of 45% by weight/55% by weight) and R507 (HFC-125/HFC-143a in a ratio of 50% by weight/50% by weight.

The refrigerator oil composition according to this invention is generally present in a refrigerator in the form of a fluid composition in which the refrigerator oil composition is mixed with the alkane fluoride as mentioned above. The mixing ratio of the refrigerator oil composition to the refrigerant (alkane fluoride) in this fluid composition may be optionally determined, but is generally a ratio of 1 to 500 parts by weight, of the refrigerator oil composition preferably 2 to 400 parts by weight, of the refrigerator oil composition per 100 parts by weight of the refrigerant.

Since the refrigerator oil composition according to this invention is excellent in electric properties and low in hygroscopicity, it is particularly suited for use in an air conditioner or a refrigerator provided with a sealed compressor of a reciprocating type or rotary type. This refrigerator oil composition is also suited for use in an air conditioner or dehumidifier for vehicles, a freezer, a refrigerating chamber, an automatic vending machine, a showcase or a cooling system for a chemical plant. This refrigerator oil composition is also applicable to a compressor of a centrifugal type. This invention will be further explained with reference to the following examples and comparative examples. However, it should be noted that these examples are not intended to restrict in any manner the scope of this invention.

EXAMPLES 1 TO 26 AND COMPARATIVE EXAMPLES 1 TO 13

The properties of the base oils used in these Examples and Comparative Examples are represented in Table 1, and the additives used therein are shown in Table 2. The distribution of molecular weights of alkylbenzenes in mixture was measured by means of mass spectrometry.

TABLE 1

| | Base oil | Kinematic viscosity ($mm^2/s$) | | Molecular wt. distribution (wt. %) | | | |
|---|---|---|---|---|---|---|---|
| | | 40° C. | 100° C. | <200 | 200–300 | 301–350 | >350 |
| A | Alkyl benzene (branched-chain type) | 8.3 | 2.10 | 5 | 93 | 2 | 0 |
| B | Alkyl benzene (branched-chain type) | 15.3 | 2.94 | 4 | 68 | 14 | 14 |
| C | Alkyl benzene (branched-chain type) | 16.9 | 3.15 | 20 | 20 | 19 | 41 |
| D | Alkyl benzene (branched-chain type) | 12.6 | 2.62 | 0 | 83 | 15 | 2 |
| E | Alkyl benzene (branched-chain type) | 29.0 | 4.30 | 2 | 49 | 24 | 25 |
| F | Alkyl benzene (branched-chain type) | 35.2 | 4.52 | 2 | 38 | 35 | 25 |
| G | Alkyl benzene (branched-chain type) | 60.8 | 5.91 | 3 | 32 | 30 | 35 |
| H | Alkyl benzene (branched-chain type) | 72.6 | 6.40 | 3 | 22 | 26 | 49 |
| I | Alkyl benzene (straight-chain type) | 15.4 | 3.18 | 0 | 61 | 30 | 9 |
| J | Alkyl benzene (straight-chain type) | 25.6 | 4.33 | 1 | 45 | 43 | 11 |
| K | Refined naphthenic mineral oil | 32.5 | 4.71 | — | | | |
| L | Tetraester (neopentylglycol/ 2-ethylhexanoic acid | 7.4 | 2.05 | — | | | |
| M | Tetraester (pentaerythritol/ ethylhexanoic acid & 3,5,5-trimethylhexanoic acid) | 66.9 | 8.18 | — | | | |

TABLE 1-continued

| | Base oil | Kinematic viscosity ($mm^2/s$) 40° C. | 100° C. | Molecular wt. distribution (wt. %) <200 | 200–300 | 301–350 | >350 |
|---|---|---|---|---|---|---|---|
| N | Di 2-ethylhexyl sebacate | 11.3 | 3.19 | — | | | |
| O | Complex ester | 59.5 | 9.71 | — | | | |
| P | polyethylene polyglycol dimethylether | 161.3 | 32.25 | Number-average Mol. Wt. 2500 | | | |
| Q | Polypropylene glycol monobutylether | 32.5 | 6.71 | Number-average Mol. Wt. 690 | | | |
| R | Tetrapropyl-etherified product of propyleneoxide addition product of α-methylglycoside | 41.4 | 7.18 | Number-average Mol. Wt. 950 | | | |
| S | Carbonate of trimethylol-propane/butanol | 42.1 | 5.59 | — | | | |
| T | Acetylized alkylbenzene | 54.3 | 4.71 | — | | | |
| U | Alkyl benzene (branched-chain type) | 15.2 | 2.90 | 1 | 72 | 17 | 10 |

Note

A, C, D, E, F, H and U: These oils were each produced by distilling a mixture of monoalkylbenzenes and dialkylbenzenes which had been prepared from, as raw materials, benzene and branched-chain olefins consisting of propylene dimers to octamers and having 6 to 24 carbon atoms, by reacting them in the presence of hydrofluoric acid as an alkylating catalyst.

B: A mixture of A and E (50% by weight:50% by weight).

G: A product obatained by the re-distillation of H.

I and J: These oils were produced by distilling a mixture of monoalkylbenzenes and dialkylbenzenes which had been prepared from, as raw materials, benzene and n-paraffin having 9 to 18 carbon atoms and separated from a kerosene fraction, by reacting them in the presence of hydrofluoric acid as an alkylating catalyst.

O: An ester obtained by reacting adipic acid, neopentyl glycol and 3,5,5-trimethylhexanol together.

T: A product obtained by reacting the alkylbenzenes of A with acetyl chloride in the presence of aluminum chloride.

TABLE 2

| Additive | Name of Compound |
|---|---|
| A | Tricresyl phosphate |
| B | Dioleylhydrogen phosphate |
| C | Di(2-ethylhexyl) acid phosphate |
| D | Para-tertiarybutylphenylglycidyl ether |
| E | Neodecanoic glycidyl ester |
| F | 2,6-ditertiarybutyl-p-cresol |
| G | 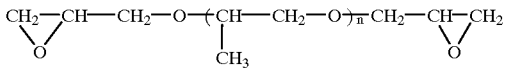 |

In the above formula, n is 2. Various kinds of refrigerator oil compositions of this invention having the compositions shown in Tables 3 and 4, respectively. The refrigerator oil compositions thus obtained were each subjected to an evaluation test for their long-term operability as illustrated in Tables 3 and 4 (Examples 1–26).

Evaluation Test

A household room air conditioner having a refrigerating capacity of 2.5 kw was filled with 350 g of a test oil and 1000 g of a mixed refrigerant consisting of HFC-134a/HFC-32 in a ratio by weight of 70% to :30% was placed in a thermostatic room kept at an atmospheric temperature of 43° C. and then subjected to a continuous operation of 500 hours while setting the air conditioner to maintain the room at 25° C., in order to evaluate the test oil for its operability.

Evaluation Test 2

A household three-door type refrigerator having an effective inner volume of 300 liters was filled with 180 g of a refrigerant consisting of HFC-134a and 150 g of a test oil, housed in a thermostatic room kept at an atmospheric temperature of 43° C. and then subjected to a continuous operation of 500 hours while setting the temperatures of the freezing chamber and the cooling chamber to −18° C. and 3° C. respectively, in order to evaluate the test oil for its operability (or performance).

Evaluation Test 3

An evaluation test was conducted using the same test oils as those which were recognized as being excellent in the above Evaluation Tests 1 and 2 by the use of a rolling piston type compressor in which 50 g of a refrigerant consisting of HFC-134a and 70 g of a test oil were filled. Then, the compressor so filled was subjected to a continuous operation of 1000 hours under the conditions of a discharge pressure of 16 $kgf/cm^2G$, a suction pressure of 0 $kgf/cm^2G$, a revolving speed of 3000 rpm and a test temperature of 160° C. After 1000 hours of the test, the surface roughness of sliding surface portion of the compressor vanes was measured.

For the purpose of comparison, the same evaluation tests as those conducted above were also performed on various refrigerator oil compositions as indicated in Table 5, i.e., a composition comprising only an alkylbenzene oil containing less than 60% by weight (based on the total weight of the component (A)) of alkylbenzenes having a molecular weight of 200 to 350 in the component (A) (Comparative Examples 1 to 4); a composition comprising a refined naphthene-based mineral oil as the component (A) (Comparative Example 5);

a composition containing only the component (B) (Comparative Examples 6 to 9); and a composition containing the component (B) in a mixing ratio falling outside the range defined by this invention (Comparative Examples 10 to 13). The results of these tests are also shown in Table 5.

TABLE 3

| | | | Example | | | | | | |
|---|---|---|---|---|---|---|---|---|---|
| | | | 1 | 2 | 3 | 4 | 5 | 6 | 7 |
| Composition (wt. %) | Base oil | (A) | A [95.0] | A [80.0] | B [95.0] | B [85.0] | B [70.0] | D [90.0] | D [80.0] |
| | | (B) | L [5.0] | M [20.0] | L [5.0] | M [15.0] | O [30.0] | M [10.0] | P [20.0] |
| | Additive | (C) | — | — | — | — | — | — | — |
| | | others | — | — | — | F [0.5] | — | E [0.5] F [0.3] | — |
| Performances evaluated | Test 1 | | S | S | S | S | S | S | S |
| | Test 2 | | S | S | S | S | S | S | S |
| | Test 3 (μm) | | 0.13 | 0.19 | 0.14 | 0.17 | 0.21 | 0.16 | 0.17 |

| | | | Example | | | | |
|---|---|---|---|---|---|---|---|
| | | | 8 | 9 | 10 | 11 | 12 |
| Composition (wt. %) | Base Oil | (A) | D [75.0] | D [90.0] | E [95.0] | E [80.0] | F [90.0] |
| | | (B) | S [25.0] | T [10.0] | N [5.0] | E [20.0] | M [10.0] |
| | Additive | (C) | — | — | — | — | — |
| | | others | D [1.0] F [0.3] | — | — | — | — |
| Performances evaluated | Test 1 | | S | S | S | S | S |
| | Test 2 | | S | S | S | S | S |
| | Test 3 (μm) | | 0.19 | 0.15 | 0.13 | 0.15 | 0.11 |

Note: S = Satisfactory

TABLE 4

| | | | Example | | | | | | |
|---|---|---|---|---|---|---|---|---|---|
| | | | 13 | 14 | 15 | 16 | 17 | 18 | 19 |
| Composition (wt. %) | Base Oil | (A) | F [80.0] | G [80.0] | I [90.0] | I [80.0] | J [90.0] | A [80.0] | B [85.0] |
| | | (B) | Q [20.0] | P [20.0] | L [10.0] | M [20.0] | Q [10.0] | M [20.0] | M [15.0] |
| | Additive | (C) | — | — | — | — | — | A [1.0] | B [0.1] |
| | | others | — | — | D [0.5] F [0.5] | — | — | — | F [0.5] |
| Performances evaluated | Test 1 | | S | S | S | S | S | S | S |
| | Test 2 | | S | S | S | S | S | S | S |
| | Test 3 (μm) | | 0.16 | 0.12 | 0.11 | 0.14 | 0.15 | 0.04 | 0.04 |

| | | | Example | | | | | | |
|---|---|---|---|---|---|---|---|---|---|
| | | | 20 | 21 | 22 | 23 | 24 | 25 | 26 |
| Composition (wt. %) | Base Oil | (A) | D [75.0] | E [80.0] | F [80.0] | I [80.0] | J [90.0] | U [80.0] | U [80.0] |
| | | (B) | S [25.0] | R [20.0] | Q [20.0] | M [20.0] | Q [10.0] | M [20.0] | M [20.0] |
| | Additive | (C) | A [3.0] | C [0.1] | A [1.0] | B [0.1] | C [0.1] | — | A [1.0] |
| | | others | D [1.0] F [0.3] | — | — | — | — | — | F [0.1] |

TABLE 4-continued

| | | | | | | | | |
|---|---|---|---|---|---|---|---|---|
| Performances evaluated | Test 1 | S | S | S | S | S | S | S |
| | Test 2 | S | S | S | S | S | S | S |
| | Test 3 (μm) | 0.06 | 0.03 | 0.03 | 0.05 | 0.04 | 0.15 | 0.04 |

Note: S = Satisfactory

TABLE 5

| | | | Comparative Example | | | | | | |
|---|---|---|---|---|---|---|---|---|---|
| | | | 1 | 2 | 3 | 4 | 5 | 6 | 7 |
| Composition (wt. %) | Base Oil | (A) | C [85.0] | C [85.0] | II [80.0] | II [80.0] | K [80.0] | — | — |
| | | (B) | M [15.0] | M [15.0] | Q [20.0] | Q [20.0] | N [100.0] | M [100.0] | M [100.0] |
| | Additive | (C) | — | B [0.1] | — | A [1.0] | — | — | A [1.0] |
| | | others | F [0.5] | F [0.5] | — | — | — | — | — |
| Performances evaluated | Test 1 | | 210 h seized | 215 h seized | 350 h seized | 360 h seized | 420 h seized | S | S |
| | Test 2 | | 235 h seized | 250 h seized | 420 h seized | 450 h seized | 425 h seized | S | S |
| | Test 3 (μm) | | — | — | — | — | — | 0.54 | 0.52 |

| | | | Comparative Example | | | | | |
|---|---|---|---|---|---|---|---|---|
| | | | 8 | 9 | 10 | 11 | 12 | 13 |
| Composition (wt. %) | Base Oil | (A) | — | — | B [50.0] | B [50.0] | F [50.0] | F [50.0] |
| | | (B) | Q [100.0] | Q [100.0] | M [50.0] | M [50.0] | Q [50.0] | Q [50.0] |
| | Additive | (C) | — | A [1.0] | — | A [1.0] | — | A [1.0] |
| | | others | — | — | — | — | — | — |
| Performances evaluated | Test 1 | | S | S | S | S | S | S |
| | Test 2 | | S | S | S | S | S | S |
| | Test 3 (μm) | | 0.76 | 0.75 | 0.48 | 0.47 | 0.61 | 0.60 |

Note: S = Satisfactory

EXAMPLES 27 TO 30-a AND COMPARATIVE EXAMPLES 14 TO 17-*a*

There were prepared various, kinds of the refrigerator oil compositions of this invention having their respective, compositions shown in Table 6 (Examples 27 to 30-a). The refrigerator oil compositions thus prepared were subjected to the following Oil-return Property Test 1 as indicated below. The results obtained are shown in Table 6.

Oil-return Property Test 1

An experimental apparatus shown in FIG. 1 was employed, and 5.0 g of an oil was filled into the portion of the thermostatic tank in which the copper conduit of 1.5 m in length and 0.0036 m in inner diameter was dipped. The temperature of the thermostatic tank was set to −220° C., and HFC-134a was allowed to flow at a flow rate of 0.001 $m^3$. 30 minutes later, the amount of oil collected in the oil pan was measured, and, based on this measurement, an oil-return ratio was calculated according to the following equation.

$$\text{Oil-return ratio (wt. \%)} = (\text{Amount (g) of oil collected})/5.0(\text{g}) \times 100$$

For the purpose of comparison, the same evaluation test as mentioned above was conducted using a refrigerating oil composition containing only the component (A) as the base oil as indicated in Table 6. The results obtained are shown in Table 6.

TABLE 6

| | | | Example | | | | | Comparative Example | | | | |
|---|---|---|---|---|---|---|---|---|---|---|---|---|
| | | | 27 | 28 | 29 | 30 | 30-a | 14 | 15 | 16 | 17 | 17-a |
| Composition (wt. %) | Base Oil | (A) | A [85.0] | A [85.0] | I [85.0] | I [85.0] | A [85.0] | A [100.0] | A [100.0] | I [100.0] | I [100.0] | A [100.0] |
| | | (B) | L [15.0] | L [15.0] | N [15.0] | N [15.0] | L [15.0] | — | — | — | — | — |
| | Additive | (C) | — | A [1.0] | — | B [0.1] | — | — | A [1.0] | — | B [0.1] | — |
| | | Others | — | — | — | F | G | — | — | — | F | G |

TABLE 6-continued

| | Example | | | | | Comparative Example | | | | |
|---|---|---|---|---|---|---|---|---|---|---|
| | 27 | 28 | 29 | 30 | 30-a | 14 | 15 | 16 | 17 | 17-a |
| | | | | [0.5] | [0.5] | | | | [0.5] | [0.5] |
| Oil-returning ratio (wt. %) | 39 | 39 | 30 | 31 | 39 | 26 | 27 | 18 | 17 | 27 |

EXAMPLES 31 TO 56 AND COMPARATIVE EXAMPLES 18 TO 30

There were prepared various kinds of the refrigerator oil compositions of this invention having their respective compositions shown in Tables 7 and 8 (Examples 31 to 56). The refrigerator oil compositions thus prepared were subjected to an evaluation test for their long-term operability as indicated below. The results obtained are shown in Tables 7 and 8.

Evaluation Test 4

A household room air conditioner having a refrigerating capacity of 2.5 kw was filled with 350 g of a test oil and 1000 g of a mixed refrigerant consisting of HFC-125/HFC-32/HFC-134a in a ratio of 25% by weight/52% by weight/23% by weight, was placed in a thermostatic room kept at an atmospheric temperature of 43° C., and then subjected to a continuous operation of 500 hours while setting the air conditioner to maintain the room at 25° C., in order to evaluate the test oil for its operability (or performance).

Evaluation Test 5

A household three-door type refrigerator having an effective inner volume of 300 L was filled with 150 g of a test oil, and 180 g of a mixed refrigerant consisting of HFC-125/HFC-134a/HFC-143a in a ratio of 44% by weight/4% by weight/52% by weight, placed in a thermostatic room whose atmospheric temperature was kept at 43° C. and then subjected to a continuous operation of 500 hours while setting the temperatures of the freezing chamber and the cooling chamber to -18° C. and 3° C. respectively, in order to evaluate the test oil for operability (performance).

Evaluation Test 6

An evaluation test was conducted using the same test oils as those which were recognized as being excellent in the above Evaluation Tests 4 and 5 by the use of a rolling piston type compressor, in which 70 g of a test oil and 50 g of a mixed refrigerant consisting of HFC-125/HFC-32 in a ratio of 50% by weight/50% by weight were filled. Then, the compressor so filled was subjected to a continuous operation of 1000 hours under the conditions of a discharge pressure of 16 kgf/cm$^2$G, a suction pressure of 0 kgf/cm$^2$G, a revolving speed of 3000 rpm and a test temperature of 160° C. After 1000 hours of the test, the surface roughness of sliding surface portion of the compressor vanes was measured.

For the purpose of comparison, the same evaluation tests as conducted above were also performed on various refrigerator oil compositions as indicated in Table 9, i.e., a composition comprising only an alkylbenzene oil alkylbenzenes containing less than 60% by weight (based on the total weight of the component (A)) of the alkylbenzenes having a molecular weight of 200 to 350 in the component (A) (Comparative Examples 18 to 21); a composition comprising a refined naphthene-based mineral oil as the component (A) (Comparative Example 22); a composition containing only the component (B) (Comparative Examples 23 to 26); and a composition containing the component (B) in a mixing ratio falling outside the range defined by this invention (Comparative Examples 27 to 30). The results of these tests are also shown in Table 9.

TABLE 7

| | | | Example | | | | | | |
|---|---|---|---|---|---|---|---|---|---|
| | | | 31 | 32 | 33 | 34 | 35 | 36 | 37 |
| Composition (wt. %) | Base Oil | (A) | A [95.0] | A [80.0] | B [95.0] | B [85.0] | B [70.0] | D [90.0] | D [80.0] |
| | | (B) | L [5.0] | M [20.0] | L [5.0] | M [15.0] | O [30.0] | M [10.0] | P [20.0] |
| | Additive | (C) | — | — | — | — | — | — | — |
| | | others | — | — | — | F [0.5] | — | E [0.5] F [0.3] | — |
| Performances evaluated | Test 4 | | S | S | S | S | S | S | S |
| | Test 5 | | S | S | S | S | S | S | S |
| | Test 6 (μm) | | 0.14 | 0.18 | 0.16 | 0.15 | 0.20 | 0.15 | 0.16 |

| | | | Example | | | | |
|---|---|---|---|---|---|---|---|
| | | | 38 | 39 | 40 | 41 | 42 |
| Composition (wt. %) | Base Oil | (A) | D [75.0] | D [90.0] | E [95.0] | E [80.0] | F [90.0] |
| | | (B) | S [25.0] | T [10.0] | N [5.0] | R [20.0] | M [10.0] |

TABLE 7-continued

| | | | | | | | |
|---|---|---|---|---|---|---|---|
| | Additive | (C) | — | — | — | — | — |
| | | others | D [1.0] F [0.3] | — | — | — | — |
| Performances evaluated | Test 4 | | S | S | S | S | S |
| | Test 5 | | S | S | S | S | S |
| | Test 6 (μm) | | 0.20 | 0.14 | 0.13 | 0.15 | 0.14 |

Note: S = Satisfactory

TABLE 8

| | | | Example | | | | | | |
|---|---|---|---|---|---|---|---|---|---|
| | | | 43 | 44 | 45 | 46 | 47 | 48 | 49 |
| Composition (wt. %) | Base Oil | (A) | F [80.0] | G [80.0] | I [90.0] | I [80.0] | J [90.0] | A [80.0] | B [85.0] |
| | | (B) | Q [20.0] | P [20.0] | L [10.0] | M [20.0] | Q [10.0] | M [20.0] | M [15.0] |
| | Additive | (C) | — | — | — | — | — | A [1.0] | B [0.1] |
| | | others | — | — | D [0.5] F [0.5] | — | — | — | F [0.5] |
| Performances evaluated | Test 4 | | S | S | S | S | S | S | S |
| | Test 5 | | S | S | S | S | S | S | S |
| | Test 6 (μm) | | 0.15 | 0.14 | 0.11 | 0.15 | 0.18 | 0.04 | 0.03 |

| | | | Example | | | | | | |
|---|---|---|---|---|---|---|---|---|---|
| | | | 50 | 51 | 52 | 53 | 54 | 55 | 56 |
| Composition (wt. %) | Base Oil | (A) | D [75.0] | E [80.0] | F [80.0] | I [80.0] | J [90.0] | U [80.0] | U [90.0] |
| | | (B) | S [25.0] | R [20.0] | Q [20.0] | M [20.0] | Q [10.0] | M [20.0] | M [20.0] |
| | Additive | (C) | A [3.0] | C [0.1] | A [1.0] | B [0.1] | C [0.1] | — | A [1.0] |
| | | others | D [1.0] F [0.3] | — | — | — | — | — | F [0.1] |
| Performances evaluated | Test 4 | | S | S | S | S | S | S | S |
| | Test 5 | | S | S | S | S | S | S | S |
| | Test 6 (μm) | | 0.05 | 0.05 | 0.04 | 0.04 | 0.03 | 0.16 | 0.06 |

Note: S = Satisfactory

TABLE 9

| | | | Comparative Example | | | | | | |
|---|---|---|---|---|---|---|---|---|---|
| | | | 18 | 19 | 20 | 21 | 22 | 23 | 24 |
| Composition (wt. %) | Base Oil | (A) | C [85.0] | C [85.0] | II [80.0] | II [80.0] | K [80.0] | — | — |
| | | (B) | M [15.0] | M [15.0] | Q [20.0] | Q [20.0] | N [20.0] | M [100.0] | M [100.0] |
| | Additive | (C) | — | B [0.1] | — | A [1.0] | — | — | A [1.0] |
| | | others | F [0.5] | F [0.5] | — | — | — | — | — |
| Performances evaluated | Test 4 | | 200 h seized | 250 h seized | 410 h seized | 405 h seized | 470 h seized | S | S |
| | Test 5 | | 220 h seized | 280 h seized | 415 h seized | 440 h seized | 495 h seized | S | S |
| | Test 6 (μm) | | — | — | — | — | — | 0.48 | 0.49 |

| | | | Comparative Example | | | | | |
|---|---|---|---|---|---|---|---|---|
| | | | 25 | 26 | 27 | 28 | 29 | 30 |
| Composition | Base Oil | (A) | — | — | B | B | F | F |

TABLE 9-continued

| | | | | | | | | |
|---|---|---|---|---|---|---|---|---|
| (wt. %) | | | | | [50.0] | [50.0] | [50.0] | [50.0] |
| | | (B) | Q [100.0] | Q [100.0] | M [50.0] | M [50.0] | Q [50.0] | Q [50.0] |
| | Additive | (C) | — | A [1.0] | — | A [1.0] | — | A [1.0] |
| | | others | — | — | — | — | — | — |
| Performances evaluated | Test 4 | | S | S | S | S | S | S |
| | Test 5 | | S | S | S | S | S | S |
| | Test 6 (μm) | | 0.61 | 0.59 | 0.45 | 0.42 | 0.58 | 0.51 |

Note: S = Satisfactory

EXAMPLES 57 TO 61 AND COMPARATIVE EXAMPLES 30 TO 35

There were prepared various kinds of the refrigerator oil compositions of this invention having their respective compositions shown in Table 10 (Examples 57to 61). The refrigerator oil compositions thus prepared were subjected to the following Oil-return Property Test 2 as indicated below. The results obtained are shown in Table 10.

Oil-return Property Test 2

An experimental apparatus shown in FIG. 1 was employed, and 5.0 g of an oil was filled into the portion of the thermostatic tank in which the copper conduit, 1.5 m in length and 0.0036 m in inner diameter, was dipped. The temperature of the thermostatic tank was set to −220° C., and a mixed refrigerant consisting of HFC-125/HFC-32/HFC-134a (25 wt. %/23 wt. %/52 wt. %) was allowed to flow at a flow rate of 0.001 $m^3$. 30 minutes later, the amount of the oil collected in the oil pan was measured, and, based on this measurement, an oil-return ratio was calculated according to the following equation.

$$\text{Oil-return ratio (wt. \%)}=(\text{Amount (g) of oil collected})/5.0(\text{g})\times 100$$

For the purpose of comparison, the same evaluation test as mentioned above was conducted using a refrigerating oil composition containing only the component (A) as the base oil as indicated in Table 10.

The results obtained are also shown in Table 10.

ment in the surface roughness of sliding surface portion of the compressor vanes over the refrigerator oil compositions of Examples 1 to 17, 25, 31 to 47 and 55, thus clearly demonstrating the remarkable effect of the phosphorus compound on the improvement in wear resistance.

By contrast, when there were used the refrigerator oil compositions of Comparative Examples 1 to 4 and 18 to 21 shown respectively in FIGS. 5 and 9, each comprising, as the component (A), an alkylbenzene oil (alkylbenzenes) containing less than 60% by weight (based on the total weight of the component (A)) of the alkylbenzenes having a molecular weight ranging from 200 to 350, the seizure of a refrigerating compressor used was recognized, thus indicating that they cannot be reliably used for a long period of time. It was also recognized that the generation of the seizure of the refrigerating compressor could not be avoided even if a phosphorus compound was added to these refrigerator oil compositions of the Comparative Examples. This tendency was also recognized in the cases of the Comparative Examples 5 and 22 using a naphthene-based mineral oil as the component (A).

On the other hand, when the refrigerator oil compositions of Comparative Examples 6 and 23, each comprising only pentaerythritol ester as the component (B), and of Comparative Examples 8 and 25, each comprising only polypropylene glycol monoalkyl ether as the component (B), were used, they indicated far poor wear resistance as compared with the refrigerator oil composition of this invention, even though they did not cause the seizure of the refrigerating compressor.

TABLE 10

| | | | Example | | | | | Comparative Example | | | | |
|---|---|---|---|---|---|---|---|---|---|---|---|---|
| | | | 57 | 58 | 59 | 60 | 61 | 31 | 32 | 33 | 34 | 35 |
| Composition (wt. %) | Base Oil | (A) | A [85.0] | A [85.0] | I [85.0] | I [85.0] | A [85.0] | A [100.0] | A [100.0] | I [100.0] | I [100.0] | A [100.0] |
| | | (B) | L [15.0] | L [15.0] | N [15.0] | N [15.0] | L [15.0] | — | — | — | — | — |
| | Additive | (C) | — | A [1.0] | — | B [0.1] | — | — | A [1.0] | — | B [0.1] | — |
| | | Others | — | — | — | F [0.5] | G [0.5] | — | — | — | F [0.5] | G [0.5] |
| Oil-returning ratio (wt. %) | | | 37 | 38 | 31 | 31 | 38 | 24 | 24 | 16 | 15 | 24 |

As apparent from the results of the performance evaluation tests shown in Tables 3 and 4 as well as shown in Tables 7 and 8, the refrigerator oil compositions of this invention did not cause the seizure of refrigerating compressor and were excellent in lubricity, thus making it possible to maintain a high reliability for a long period of time.

In particular, the refrigerator oil compositions of Examples 18 to 24, 26, 48 to 54 and 56, each containing a phosphorus compound (C), indicated a remarkable improve- Further, the refrigerator oil compositions of Comparative Examples 7, 9, 24 and 26, which were prepared by adding a phosphorus compound (C) to the same refrigerator oils as those of Comparative Examples 6, 8, 23 and 25, respectively, did not exhibit any substantial improvement, in wear resistance. This clearly demonstrates a synergistic effect of the base oil (the components (A) and (B)) and a phosphorus compound (C) in the refrigerator oil composition of this invention.

On the other hand, as apparent from the results of oil-return property test shown in FIGS. 6 and 10, the refrigerator oil composition of this invention is far excellent in oil-return property of the refrigerator oil as compared with those of Comparative Examples 14 to 17 and 31 to 34, each containing only the component (A) as a base oil.

Comparative Examples 36 to 41

The properties of the base oils used in these Comparative Examples are represented in Table 11. The distribution of molecular weight of alkylbenzenes in mixture was measured by means of mass spectrometry.

TABLE 11

| | Base oil | Kinematic viscosity ($mm^2/s$) 40° C. | 100° C. | Molecular wt. distribution (wt. %) <200 | 200–300 | 301–350 | >350 |
|---|---|---|---|---|---|---|---|
| M | Tetraester (pentaerythritol/ethylhexanoic acid & 3,5,5-trimethylhexanoic acid) | 66.9 | 8.18 | | — | | |
| V | Alkylbenzene (branched-chain type) | 32.30 | 4.229 | 2 | 33 | 20 | 45 |
| W | Alkylbenzene (branched-chain type) | 37.25 | 4.567 | 2 | 29 | 21 | 48 |
| X | Alkylbenzene (branched-chain type) | 60.97 | 5.847 | 2 | 20 | 24 | 54 |

As seen from the Table 11, each of alkylbenzene oils V, W and X contains less than 60% by weight, based on the total weight of the alkylbenzene oil, of alkylbenzenes having a molecular weight of 200 to 350, though they have kinematic viscosities which are close to those of the base oils E, F and G shown in Table 1.

Then, various kinds of the refrigerator oil compositions having the compositions shown in Table 12 were prepared. The refrigerator oil compositions thus obtained were each subjected to the same evaluation tests as those aforementioned for their long-term operability. The results obtained are also shown in Table 12.

TABLE 12

| | | Comparative Example 36 | 37 | 38 | 39 | 40 | 41 |
|---|---|---|---|---|---|---|---|
| Base oil (wt. %) | (A) | V [80.0] | V [80.0] | W [80.0] | W [80.0] | X [80.0] | X [80.0] |
| | (B) | M [20.0] | M [20.0] | M [20.0] | M [20.0] | M [20.0] | M [20.0] |
| Additive (C) (wt. part) *1 | | | B [1.0] | | B [1.0] | | B [1.0] |
| Performances evaluated | Test 1 | 425h seized | 450h seized | 420h seized | 450h seized | 300h seized | 350h seized |
| | Test 2 | 430h seized | 460h seized | 425h seized | 460h seized | 360h seized | 400h seized |
| | Test 4 | 400h seized | 435h seized | 350h seized | 405h seized | 280h seized | 295h seized |
| | Test 5 | 420h seized | 450h seized | 400h seized | 440h seized | 315h seized | 330h seized |

*1: based on 100 parts by weight of the base oils (A) and (B)

As seen from the Table 12, when there are used refrigerator oil compositions each comprising an alkylbenzene oil which contains less than 60% by weight, based on the total weight of alkylbenzene oil, of alkylbenzenes having a molecular weight of 200 to 350, the seizure of a refrigerating compressor used is recognized.

As explained above, the refrigerator oil composition of this invention is suited for use in an HFC refrigerant containing HFC-134a and/or HFC-125, featured in that enables the generation of seizure of the refrigerating compressor to be avoided and excellent in lubricity, thus making it possible to maintain a high reliability for a long period of time. Therefore, the refrigerator oil composition of this invention is highly useful as a refrigerator oil composition to be utilized together with an HFC refrigerant containing HFC-134a and/or HFC-125. As explained above, it has been made possible to provide a refrigerator oil composition slatted for use with an HFC refrigerant containing HFC-134a and/or HFC-125, and to provide a refrigerator fluid composition comprising such a refrigerator oil composition as mentioned above and an HFC refrigerant containing HFC-134a and/or HFC-125.

What is claimed is:

1. A refrigerator oil composition for use with an HFC refrigerant containing HFC-134a, HFC-125 or a mixture thereof, which comprises component (A) and component (B), said component (A) being 70 to 99% by weight of an alkylbenzene oil containing at least 60% by weight, based on the total weight of component (A), of alkylbenzenes having a molecular weight of 200 to 350, said alkylbenzenes having a kinematic viscosity of 3 to less than 72.6 $mm^2$ /s at a temperature of 40° C., said component (B) being 30 to 1% by weight of at least one synthetic oil containing oxygen, said synthetic oil being a member selected from the group consisting of a dibasic ester, a polyol ester, a complex ester, a polyol carbonate, a polyalkylene glycol, an alkyl ether of said polyalkylene glycol, an adduct of a polyol with an alkylene oxide, an alkyl ether of said adduct of a polyol with an alkylene oxide, an ester of a polyalkylene glycol, an ester of a monoalkyl ether of a polyalkylene glycol, an ester of an adduct of said polyol with an alkylene oxide, an ester of a partial alkyl ether of said adduct of a polyol with an alkylene oxide, a ketone and a mixture thereof.

2. A refrigerator fluid composition which comprises:

(I) an HFC refrigerant containing HFC-134a, HFC-125 or a mixture thereof and (II) a refrigerator oil comprising component (A) and component (B), said component (A) being 70 to 99% by weight of an alkylbenzene oil containing at least 60% by weight, based on the total weight of component (A), of alkylbenzenes having a molecular weight of 200 to 350, said alkylbenzenes having a kinematic viscosity of 3 to less than 72.6 $mm^2/s$ at a temperature of 40° C., said component (B) being 30 to 1% by weight of at least one synthetic oil containing oxygen, said synthetic oil being a member selected from the group consisting of a dibasic ester, a polyol ester, a complex ester, a polyol carbonate, a polyalkylene glycol, an alkyl ether of said polyalkylene glycol, an adduct of a polyol with an alkylene oxide, an alkyl ether of said adduct of a polyol with an alkylene oxide, an ester of a polyalkylene glycol, an ester of a monoalkyl ether of a polyalkylene glycol, an ester of said adduct of a polyol with an alkylene oxide, an ester of a partial alkyl ether of an adduct of a polyol with an alkylene oxide, a ketone and a mixture thereof.

3. A refrigerator oil composition according to claim 1, further comprising component (C), said component (C) being 0.005 to 5.0 parts by weight, based on 100 parts by weight of mixed base oil comprising said components (A), (B) and (C), of a phosphorus compound.

4. A refrigerator oil Composition according to claim 1, wherein said alkylbenzene oil (contains at least 65% by weight, based on the total weight of said Component (A), of alkylbenzenes having a molecular weight of 200 to 350.

5. A refrigerator oil composition according to claim 1, wherein said alkylbenzene oil contains at least 70% by weight, based on the total weight of said component (A), of alkylbenzenes having a molecular weight of 200 to 350.

6. A refrigerator oil composition according to claim 1, wherein said alkylbenzene oil contains at least 80% by weight, based on the total weight of said component (A), of alkylbenzenes having a molecular weight of 200 to 350.

7. A refrigerator oil composition according to claim 1, wherein said alkylbenzene oil contains 100% by weight, based on the total weight of said component (A), of alkylbenzenes having a molecular weight of 200 to 350.

8. A refrigerator oil composition according to claim 1, wherein said alkylbenzene oil contains at least 30% by weight, based on the total weight of said component (A), of alkylbenzenes having a molecular weight of 200 to 300 and at least 60% by weight, based on the total weight of said component (A), of alkylbenzenes having a molecular weight of 200 to 350.

9. A refrigerator oil composition according to claim 1, wherein said alkylbenzene oil contains at least 35% by weight, based on the total weight of said component (A), of alkylbenzenes having a molecular weight of 200 to 300 and at least 60% by weight, based on the total weight of said component (A), of alkylbenzenes having a molecular weight of 200 to 350.

10. A refrigerator oil composition according to claim 1, wherein said alkylbenzene oil contains at least 40% by weight, based on the total weight of said component (A), of alkylbenzenes having a molecular weight of 200 to 300 and at least 60% by weight, based on the total weight of said component (A), of alkylbenzenes having a molecular weight of 200 to 350.

11. A refrigerator oil composition according to claim 1, wherein said alkylbenzenes having a molecular weight of 200 to 350 have 1 to 4 alkyl groups, each group containing 1 to 19 carbon atoms and the total amount of carbon atoms in the alkyl groups being 9 to 19.

12. A refrigerator oil composition according to claim 11, wherein said alkylbenzenes are selected from the group consisting of a monoalkylbenzene, a dialkylbenzene and a mixture thereof.

13. A refrigerator oil composition according to claim 1, wherein said alkylbenzenes having a molecular weight of 200 to 350 have 1 to 4 alkyl groups, each group containing 1 to 15 carbon atoms and the total amount of carbon atoms in the alkyl groups being 9 to 15.

14. A refrigerator oil composition according to claim 1, wherein alkyl groups of said alkylbenzenes having a molecular weight of 200 to 350 are branched-chain alkyl groups.

15. A refrigerator oil composition according to claim 14, wherein said branched-chain alkyl groups are derived from oligomers of olefins.

16. A refrigerator fluid composition according to claim 2, wherein said refrigerator oil further comprises component (C), said component (C) being 0.005 to 5.0 parts by weight, based on 100 parts by weight of mixed based oil comprising said components (A), (B) and (C), of a phosphorus compound.

17. A refrigerator oil composition for use with an HFC refrigerant containing HFC-134a, HFC-125 or a mixture thereof, which composition comprises component (A) and component (B), said component (A) being 70 to 99% by weight of an alkylbenzene oil containing at least 60% by weight, based on the total weight of component (A), of alkylbenzenes having a molecular weight of 200 to 350, said alkylbenzenes having a kinematic viscosity of 3 to less than 72.6 $mm^2/s$ at a temperature of 40° C., said component (B) being 30 to 1% by weight of a synthetic oil containing oxygen.

18. A refrigerator fluid composition which comprises:

(I) an HFC refrigerant containing HFC-134a, HFC-125 or a mixture thereof and (II) a refrigerator oil comprising component (A) and component (B), said component (A) being 70 to 99% by weight of an alkylbenzene oil containing at least 60% by weight, based on the total weight of component (A), of alkylbenzenes having a molecular weight of 200 to 350, said alkylbenzenes having a kinematic viscosity of 3 to less than 72.6 $mm^2/s$ at a temperature of 40° C., said component (B) being 30 to 1% by weight of a synthetic oil containing oxygen.

* * * * *